US007428905B2

(12) United States Patent
Mua

(10) Patent No.: US 7,428,905 B2
(45) Date of Patent: Sep. 30, 2008

(54) METHOD OF MAKING SMOKEABLE TOBACCO SUBSTITUTE FILLER HAVING AN INCREASED FILL VALUE

(75) Inventor: John-Paul Mua, Macon, GA (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 553 days.

(21) Appl. No.: 10/902,760

(22) Filed: Jul. 30, 2004

(65) Prior Publication Data

US 2006/0021626 A1 Feb. 2, 2006

(51) Int. Cl.
*A24D 1/00* (2006.01)

(52) U.S. Cl. ..... 131/364

(58) Field of Classification Search ..... 131/364
See application file for complete search history.

(56) References Cited

U.S. PATENT DOCUMENTS

| | | | | |
|---|---|---|---|---|
| 2,613,673 | A | 10/1952 | Sartoretto et al. | |
| 3,323,524 | A | 6/1967 | Shamberger, Jr. | |
| 3,805,802 | A * | 4/1974 | Hedge et al. | 131/353 |
| 4,000,748 | A * | 1/1977 | Summers | 131/291 |
| 4,133,317 | A | 1/1979 | Briskin | |
| 4,182,349 | A * | 1/1980 | Selke | 131/374 |
| 4,195,645 | A | 4/1980 | Bradley, Jr. et al. | |
| 4,233,993 | A | 11/1980 | Miano et al. | |
| 4,256,126 | A | 3/1981 | Seligman et al. | |
| 4,296,762 | A | 10/1981 | Eicher et al. | |
| 4,306,578 | A | 12/1981 | Schmidt et al. | |
| 4,333,484 | A | 6/1982 | Keritsis | |
| 4,506,684 | A * | 3/1985 | Keritsis | 131/369 |
| 4,874,000 | A | 10/1989 | Tamol et al. | |
| 5,046,514 | A | 9/1991 | Bolt | |
| 5,056,537 | A | 10/1991 | Brown et al. | |
| 5,095,922 | A * | 3/1992 | Johnson et al. | 131/296 |
| 5,908,034 | A * | 6/1999 | Adedeji | 131/374 |
| 6,289,897 | B1 | 9/2001 | McAdam et al. | |
| 6,397,852 | B1 | 6/2002 | McAdam | |
| 6,408,856 | B1 | 6/2002 | McAdam | |
| 2005/0034739 | A1 * | 2/2005 | Dittrich et al. | 131/364 |

FOREIGN PATENT DOCUMENTS

| | | | |
|---|---|---|---|
| EP | 0419915 A2 | | 4/1991 |
| EP | 0419975 A3 | | 4/1991 |
| WO | WO 03 020056 | * | 3/2003 |
| WO | 03055337 | | 7/2003 |

* cited by examiner

*Primary Examiner*—Carlos Lopez
(74) *Attorney, Agent, or Firm*—Charles I. Sherman; Middleton Reutlinger

(57) ABSTRACT

The invention relates to a smokeable filler material having an increased fill value and processes for making the smokeable filler. The smokeable filler has a fill value of at least 5 cc/g and comprises a cellulose material, a humectant, an inert filler, a binder, and optionally a tobacco containing material.

8 Claims, 2 Drawing Sheets

*Paper Recon Process*

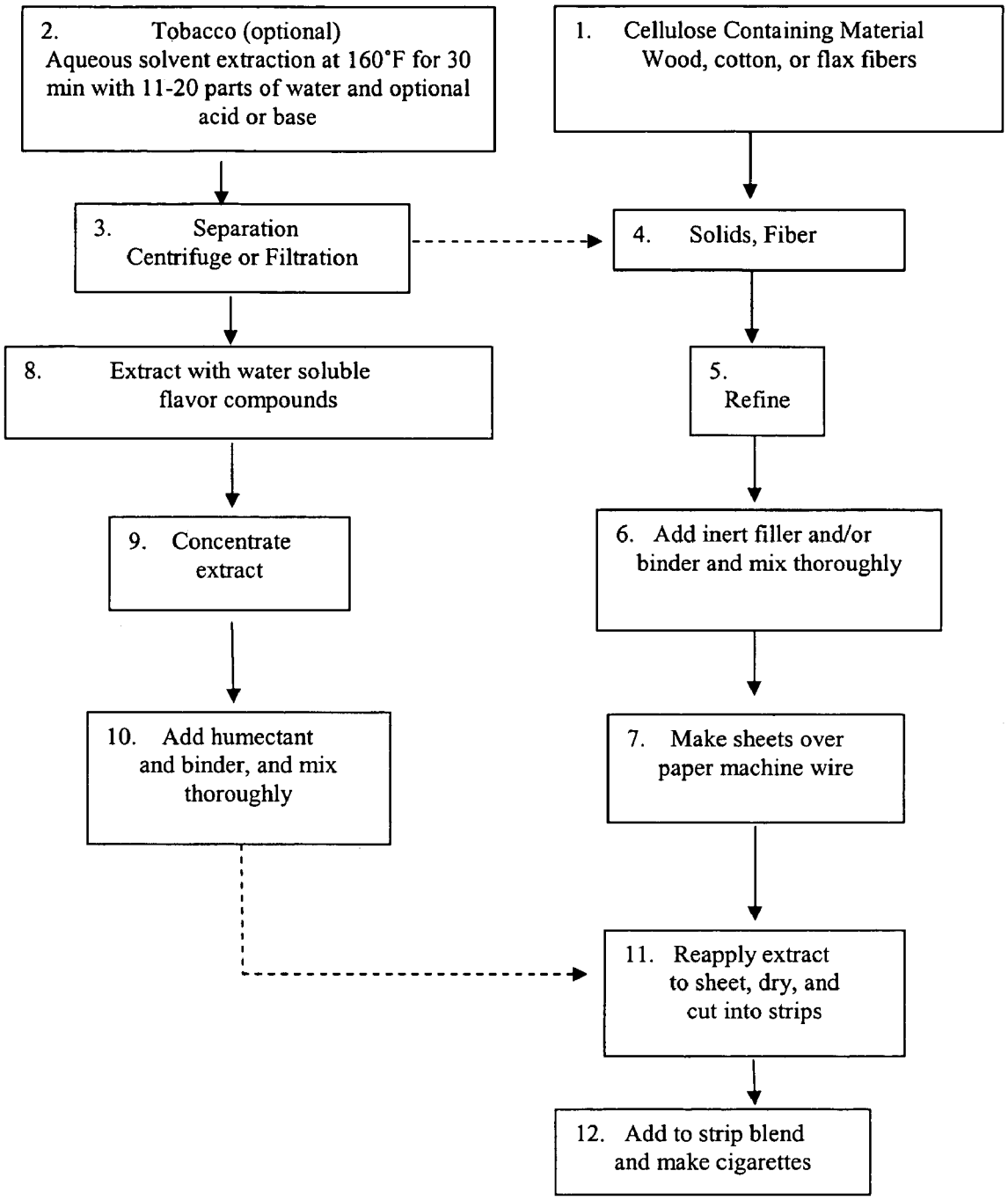
*Figure 1. Paper Recon Process*

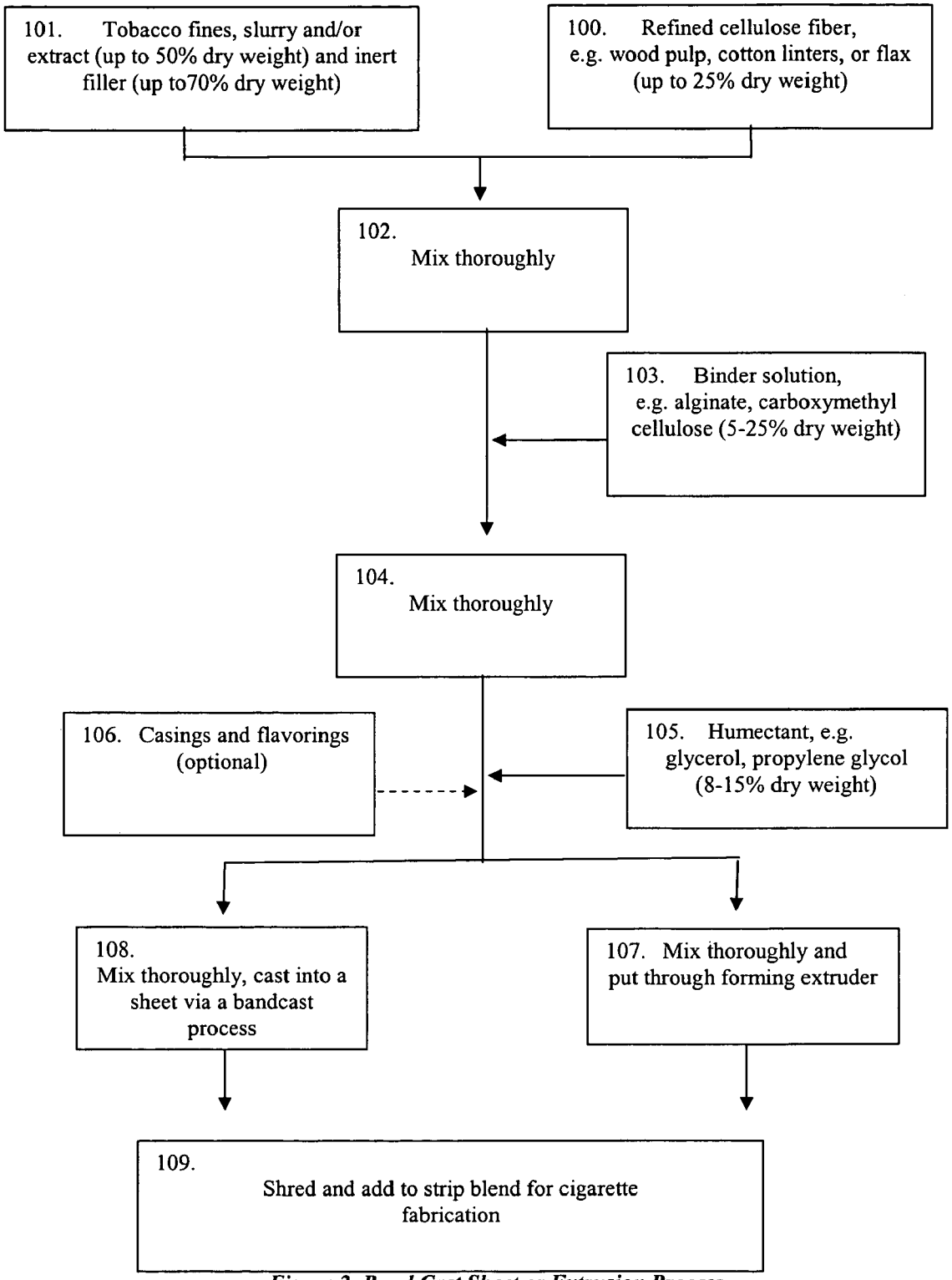
*Figure 2. Band Cast Sheet or Extrusion Process*

METHOD OF MAKING SMOKEABLE TOBACCO SUBSTITUTE FILLER HAVING AN INCREASED FILL VALUE

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

This invention relates to smokeable filler material for smoking articles, and in particular to a smokeable filler material for a smoking article where the filler has an increased fill value and closely exhibits properties of tobacco in a smoking article while reducing the Hoffman Analytes associated with tobacco.

BACKGROUND OF THE INVENTION

In the many efforts which have been made to provide alternative smokeable filler materials with reduced Hoffman Analyte delivery very few, if any, have been found which produce a smoke taste and flavor which is acceptable to smokers of conventional tobacco containing products. Many of these fillers contain mostly, if not entirely, chalk or other inert fillers. Therefore, most alternative filler materials have been used in conjunction with cut tobacco leaf or tobacco-containing reconstituted products. However, even in this form, the unacceptable taste of these filler materials is noticeable and detracts from smoking pleasure. Additionally, many of the non-tobacco filler materials have a low fill value which results in a heavy smoking article with a low burn rate, low smoke delivery, and high propensity to extinguish.

SUMMARY OF THE INVENTION

The Smokeable Tobacco Substitute Filler Having an Increased Fill Value and Method of Making Same claimed herein has a cellulose containing material, a humectant, optionally a tobacco containing material wherein a portion of the tobacco containing material may be a tobacco extract, optionally an inert material, and a binder. Additionally, the filler material of the present invention may have flavorants and casings added as desired.

The filler material claimed herein may be produced via a paper making process, bandcast process, or an extrusion process. The filler material of the present invention has a fill value of at least 5 cc/g and more closely exhibits the properties exhibited by natural tobacco.

It is an object of the present invention to provide a smokeable tobacco substitute that has an increased fill value.

It is also an object of the present invention to provide a smokeable filler material having improved tobacco taste and flavor characteristics with minimal Hoffman Analyte deliveries.

It is a further object of the invention to provide a smokeable filler material having an improved burn rate, smoke delivery, and propensity to resist extinguishing.

The present invention meets these objectives and provides additional benefits to the smoking article by replacing the large natural granular chalk found in the prior art fillers with precipitated and refined chalk having a smaller particle size and replacing at least a portion of the chalk with a less dense filler having a cellulose containing material.

The present invention provides for a smokeable filler material for a smoking article where the filler material has an increased fill value and tobacco characteristics and methods for making the smoking filler material.

More particularly, the present invention provides a smokeable filler having a fill value of at least 5 cc/g, wherein the smokeable filler has a humectant, a substantially non-combustible inert filler material, a binder, a cellulose fibrous material, and optionally a tobacco containing material.

Even more particularly, the present invention provides a process for making a smokeable filler comprising. The process comprises mixing and refining a cellulose containing material and an inert material. The inert material may be organic, inorganic or a combination of organic and inorganic. Tobacco, tobacco extract, humectant, binders, flavorants, and casings may be added at particular steps in the process to form a fiber containing material. The fiber containing material is cast into sheets via a paper making process, bandcast process, or an extrusion process. The sheet is cut into sheets into strips forming a smokeable filler having a fill value in excess of 5 cc/g.

BREIF DESCRIPTION OF THE DRAWINGS

FIG. 1 is a block diagram of the process steps representative of the present invention incorporating a paper making process.

FIG. 2 is a block diagram of the process steps representative of the present invention incorporating bandcast and extrusion processes.

DETAILED DESCRIPTION OF THE PREFERRED EMBODIMENTS

FIG. 1 shows a method of making a smoking article, such as a cigarette, according to the presently claimed invention wherein the sheet is produced via a paper making process. In step 1, a cellulose containing material derived from wood, cotton, or flax is provided. The cellulose containing material in step 1 is in an amount that makes up about 5% to 50% by weight of the sheet material obtained in step 11. Particularly, the cellulose containing material in step 1 makes up to about 10% to 15% by weight of the sheet material obtained in step 11. The use of cellulose in step 1 serves to improve the fill value of the filler material and also enables or improves the process of making sheet via a paper making process. Step 2 is an optional step of extracting tobacco. The tobacco extraction method in Step 2, used to obtain a tobacco extract and tobacco solids, may be an aqueous extraction using solely water or an aqueous extraction using other additives in the extraction process, for example, acids or bases. Typically, extraction of tobacco in Step 2 is carried out by extracting one part of tobacco with about 11 to 20 parts of an aqueous solution at about 140° to 180° F. for about 15 to 45 minutes. The aqueous solution may be acidic or basic for the release of tobacco pectin (binder) which increases sheet tensile strength, improves sheet pliability, and reduces the amount of added binder, e.g. alginate, during sheet making. In Step 3 the tobacco solids are separated from the tobacco extract by either centrifugation or filtration.

Step 4 is an optional step where the tobacco solids from Step 3 are added to the cellulose containing material of Step 1. The cellulose containing material of step 1 and, optionally, added tobacco solids in step 4 are refined in step 5. After refining in step 5, inert fillers and/or binders are mixed in step 6 with the refined material obtained in step 5. The inert materials in step 6 may be organic and/or inorganic. The organic fillers used in step 5 include chitosan and liposan while the inorganic filler materials, include, for example, calcium carbonate, magnesium carbonate, calcium oxide, and magnesium oxide. These inorganic filler materials are precipitated and refined resulting in a small particle size. Refining of the inert fillers typically involves milling the fillers to a very fine particle size such as a range of about 0.5 μm to 1 μm. This small particle size allows for making a thin sheet material and hence helps to increase the fill value of the smokeable filler when cut or shredded into strips. The inert materials in step 6 may be a single organic or inorganic inert material or may be a combination of inert materials whether organic or inorganic. The inert materials added in step 6 are in an amount that makes up to 35% by weight of the sheet material obtained in step 11. Preferably, the inert materials in step 6 make up about 20% to 25% by weight of the sheet material obtained in step 11.

In step 7 the material resulting from step 6 is formed into sheets via a paper making process. The sheet material derived from step 7 may, optionally, have a tobacco extract containing material added to the sheet in step 11. The tobacco extract in step 8 obtained by the separation from the tobacco solids in step 3 are concentrated in step 9. In step 10 a humectant and binder is mixed thoroughly with the concentrated tobacco extract of step 9. The humectant in step 10 may be added at a concentration where the resulting sheet from step 11 comprises up to 15% by weight humectant on a dry weight basis. Generally, the humectant in step 10 is added at a concentration where the resulting sheet from step 11 comprises about 12.5% by weight humectant on a dry weight basis. The binder in step 10 is in an amount that makes up about 5% to 25% by weight of the sheet material obtained in step 11. Preferably, the binder step 10 makes up to about 6% to 10% by weight of the sheet material obtained in step 11. The resulting tobacco extract containing material of step 10 is the tobacco extract that is, optionally, added to the sheet in step 11 and may make up to 30% by weight of the sheet resulting from step 11. Additionally, the sheet resulting from step 11 may contain up to 50% by weight tobacco containing materials which are, optionally, added in the process at process steps 4 and/or 11. The sheet resulting from step 11 has a fill value in excess of 4 cc/g. Preferably, the fill value of the sheet resulting from step 11 has a fill value in a range of about 6 to 10 cc/g. The sheet resulting from step 11 is then cut into strips and added to a strip blend in step 12 for making a smoking article.

FIG. 2 shows other embodiments that may be followed in practicing the present invention. The block diagram in FIG. 2 shows the process steps to be taken to produce a tobacco substitute filler having an increased fill value where the sheet is produced via a bandcast or extruding process.

In step 100, a cellulose containing material derived from wood, cotton, or flax and refined is provided. The cellulose containing material in step 100 is in an amount that makes up to 25% by weight of the sheet material to be shredded in step 109. Step 101 is an optional step of adding a tobacco containing material such as fines, slurry, extract or combinations thereof, and an inert filler. The tobacco containing material added in step 101 is in such an amount that the finished sheet to be shredded in step 109 may contain up to 50% by weight of tobacco containing material. The tobacco containing material in step 101 may have tobacco extract in an amount that makes up to 30% by weight of the sheet material obtained in step 109. Preferably, the tobacco extract material in step 101 makes up from about 10% to 20% by weight of the sheet material obtained in step 109. The inert filler that is added in step 101 is in an amount needed to produce a sheet to be shredded in step 109 having up to 70% by weight inert filler. Preferably, the inert material in step 101 makes up from about 10% to 70% by weight of the sheet material obtained in step 109. The inert filler added to the cellulose containing material in step 101 may be either organic or inorganic. The inorganic chalk fillers are precipitated and refined resulting in a small particle size, i.e. about 0.5 μm to 1 μm in diameter, which allows for the forming of a thinner sheet having an increased fill value when shredded.

In step 102 the materials resulting from steps 100 and 101 are mixed thoroughly. In step 103 a binder solution (e.g. alginate, carboxymethyl cellulose, etc.) is added to the material resulting from step 102 and mixed in step 104. The binder solution added in step 103 is in such an amount that the finished sheet to be shredded in step 109 contains from about 5% to 25% binder on a dry weight basis. In step 105, a humectant (e.g. glycerol, propylene glycol, etc.) is added in such an amount that the finished sheet to be shredded in step 109 contains from about 8% to 15% humectant. Advantageously, the finished sheet to be shredded in step 109 contains about 12.5% humectant by weight. Optionally, In step 106 casings and flavorings may be added to the mixture.

The mixture resulting from step 106 may be formed into a sheet by either an extruder in step 107 or by a bandcast process in step 108. The resulting sheet is then shredded and added to strip blend for cigarette fabrication in step 109.

The smokeable tobacco substitute filler having an increased fill value is produced by the processes shown in FIG. 1 and FIG. 2. The smokeable filler material typically comprises a cellulose containing material, a humectant, a substantially non-combustible inert filler material, a binder, and optionally a tobacco containing material, casings, and flavorings.

The humectant comprise up to 15% by weight of the filler of the present invention. However, it has been determined that a concentration of humectant over 20% may cause the wrapper of the smoking article to spot. The precise concentration at which spotting occurs depends on the concentration of other materials in the filler. In order to avoid spotting, advantageous concentrations of humectant have been determined for various embodiments of the present invention as indicated herein.

The filler material of the present invention has about 5% to 25% binder. Suitable binder materials for the present invention include the well known cellulosic or cellulosic derivative binders, alginic or pectinaceous binders. The cellulosic derivative binders include binders such as sodium carboxymethyl cellulose, methyl cellulose, hydroxypropyl cellulose, hydroxyethyl cellulose or cellulose ethers. The alginic binders include binders such as ammonium alginate, sodium alginate, sodium calcium alginate, calcium ammonium alginate, potassium alginate, magnesium alginate, triethanol-amine alginate and propylene glycol alginate, or insoluble alginates which can be rendered soluble by the addition of solubilising agents, such as ammonium hydroxide. Examples of these include aluminium, copper, zinc and silver alginates. Alginates which are initially soluble but which, during processing, undergo treatment to render them insoluble in the final product may also be used, e.g. sodium alginate going to calcium alginate. Other organic binders include gums such as gum arabic, gum ghatti, gum tragacanth, Karaya, locust bean, acacia, guar, quince seed or xantham gums, or gels such as agar, agarose, carrageenans, fucoidan and furcellaran. Pectins and pectinaceous materials can also be used as binders. Starches can also be used as organic binders. Other suitable gums can be selected. Inorganic non-combustible binders, such as potassium silicate, magnesium oxide in combination with potassium silicate, or some cements, for example, and mixtures thereof, may also be used, usually in the alternative. Combinations of all of the above may also be used as an effective binder.

Cellulose fibers may be derived from wood, cotton, or flax and typically make up approximately 5% to 50% by weight of the filler of the present invention. Preferable ranges of cellulose have been determined for the different processes in practicing the present invention as indicated herein. These ranges of cellulose in conjunction with the precipitated and refined inert materials has been determined to produce a filler material having a fill value above 4 cc/g and approximates the fill value found in natural tobacco. Additionally, these cellulose fibers have been found to reduce the spotting that is often times associated with use of humectants.

Tobacco containing materials may make up to 50% by weight of the filler material of the present invention. The source of tobacco may be in the form of tobacco fines, stems, tobacco containing slurry, extract of tobacco, concentrated extract, extracted tobacco solids, or other tobacco sources known in the art. The tobacco containing material may have tobacco extract in an amount that makes up to 30% by weight of the sheet material obtained in the processes claimed herein.

Additionally, flavorants and casings may be added to the smokeable filler as desired. Flavorants or taste materials may include menthol, licorice, coffee, tobacco, tobacco extract or other flavorings known in the art. The filler material may be cased using conventional techniques known in the art.

In order that the invention may be easily understood and readily carried into effect the following examples were performed to illustrate the invention and aspects thereof. The following Examples are incorporated herein to illustrate the present invention with no intention of being unduly limited thereby.

EXAMPLES 1-10

Several embodiments of the present invention were made according to the processes described herein and the fill value of these embodiments were measured and compared to the fill value of the tobacco filler material found in the prior art. The fill value was determined by placing a 10 g to 20 g sample of filler material into a densimeter and compressing the filler with a 2 kg piston for 30 seconds. The height of the piston in the densimeter as well as the moisture content of the samples were measured. The fill value of the samples were calculated according to the following formulas:

$$UFV(\text{cc/g})=(2.78\times H)/W$$

$$CFV(\text{cc/g})=UFV+(-0.76\times(T-M)+0.01\times(T^2-M^2)$$

Wherein UFV in an uncorrected fill value, H is the final compressed height of the piston in the densimeter, W is the weight of the sample in grams, CFV is the corrected fill value, M is the percent moisture content of the sample, and T is a target moisture of 14%.

The compositions of the filler found in the prior art and the compositions of several examples of the present invention are listed in the following tables. The examples include sheets having a basis weight from 55 g/m$^2$ to 100 g/m$^2$. The sheet materials in the following examples were made via the paper making process in FIG. 1 and the bandcast process in FIG. 2 as indicated. The results of the corrected fill value measurements of each sample is listed at the bottom of each table.

TABLE 1

| | Sheet basis weight of 100 g/m$^2$ Sheet made via bandcast process | | | | |
|---|---|---|---|---|---|
| Material | Prior Art Filler | Increased Fill Value Ex. 1 | Increased Fill Value Ex. 2 | Increased Fill Value Ex. 3 | Increased Fill Value Ex. 4 |
| Tobacco (%) | 0.0 | 0.0 | 0.0 | 10.0 | 10.0 |
| Alginate (%) | 7.5 | 10.0 | 10.0 | 8.0 | 8.0 |
| Precipitated Refined Chalk (%) | 0.0 | 61.5 | 61.5 | 55.0 | 55.0 |
| Granular Chalk (%) | 78.5 | 0.0 | 0.0 | 0.0 | 0.0 |
| Cellulose Fiber from Cotton (%) | 0.0 | 15.0 | 0.0 | 13.0 | 0.0 |
| Cellulose Fiber from Wood (%) | 0.0 | 0.0 | 15.0 | 0.0 | 13.0 |
| Glycerin (%) | 12.5 | 12.0 | 12.0 | 12.0 | 12.0 |
| Caramel (%) | 1.5 | 1.5 | 1.5 | 0.0 | 0.0 |
| Corrected Fill Value (cc/g) | 4.0 | 5.8 | 6.8 | 5.7 | 6.9 |

TABLE 2

| | Sheet basis weight of 75 g/m$^2$ Sheet made via bandcast process | | | |
|---|---|---|---|---|
| Material | Prior Art Filler | Increased Fill Value Ex. 5 | Increased Fill Value Ex. 6 | Increased Fill Value Ex. 7 |
| Tobacco (%) | 0.0 | 0.0 | 0.0 | 0.0 |
| Alginate (%) | 7.5 | 10.0 | 10.0 | 10.0 |
| Precipitated Refined Chalk (%) | 0.0 | 60.0 | 60.0 | 60.0 |
| Granular Chalk (%) | 78.5 | 0.0 | 0.0 | 0.0 |
| Cellulose Fiber from Cotton (%) | 0.0 | 15.0 | 0.0 | 0.0 |
| Cellulose Fiber | 0.0 | 0.0 | 15.0 | 0.0 |

TABLE 2-continued

| Material | Prior Art Filler | Increased Fill Value Ex. 5 | Increased Fill Value Ex. 6 | Increased Fill Value Ex. 7 |
|---|---|---|---|---|
| | Sheet basis weight of 75 g/m$^2$ Sheet made via bandcast process | | | |
| from Wood (%) | | | | |
| Cellulose Fiber from Flax (%) | 0.0 | 0.0 | 0.0 | 15.0 |
| Glycerin (%) | 12.5 | 13.0 | 13.0 | 13.0 |
| Caramel (%) | 1.5 | 2.0 | 2.0 | 2.0 |
| Corrected Fill Value (cc/g) | 4.48 | 8.51 | 8.62 | 8.88 |

TABLE 3

| Material | Prior Art Filler[a] | Increased Fill Value Ex. 8[a] | Increased Fill Value Ex. 9[a] | Increased Fill Value Ex. 10[b] |
|---|---|---|---|---|
| | Sheet basis weight of 85 g/m$^2$ | | | |
| Tobacco (%) | 0.0 | 0.0 | 10.0 | 10.0 |
| Alginate (%) | 7.5 | 10.0 | 8.0 | 8.0 |
| Precipitated Refined Chalk (%) | 0.0 | 61.5 | 55.0 | 55.0 |
| Granular Chalk (%) | 78.5 | 0.0 | 0.0 | 0.0 |
| Cellulose Fiber from Cotton (%) | 0.0 | 15.0 | 13.0 | 13.0 |
| Cellulose Fiber from Wood (%) | 0.0 | 0.0 | 0.0 | 0.0 |
| Glycerin (%) | 12.5 | 12.0 | 12.0 | 12.0 |
| Caramel (%) | 1.5 | 1.5 | 0.0 | 0.0 |
| Corrected Fill Value (cc/g) | 4.3 | 7.3 | 7.6 | 7.8 |

[a]Sheet made from bandcast process
[b]Sheet made from paper process

TABLE 4

| Material | Increased Fill Value Ex. 11 |
|---|---|
| | Sheet basis weight of 55 g/m$^2$ Sheet made via paper process |
| Tobacco (%) | 0.0 |
| Alginate (%) | 10.0 |
| Precipitated Refined Chalk (%) | 61.5 |
| Granular Chalk (%) | 0.0 |
| Cellulose Fiber from Cotton (%) | 15.0 |
| Cellulose Fiber from Wood (%) | 0.0 |
| Glycerin (%) | 12.0 |
| Caramel (%) | 1.5 |
| Corrected Fill Value (cc/g) | 8.5 |

The examples show the increased fill value obtained by the present invention. Typically, tobacco cut rag exhibits a fill value of about 6 to 7 cc/g where the filler of the prior art has a fill value of about 4 to 4.5 cc/g. The low fill value of the filler material in the prior art results in a heavy smoking article that has a poor burn rate and smoke delivery as well as a propensity to extinguish. The fill value of the filler material presently claimed was shown in the examples to be from 5.7 to 8.88 cc/g which is in a range more closely approximating what is found in tobacco cut rag. This filler material with an increased fill value produces a smoking article having a weight and other properties that more closely approximates tobacco. Additionally, the filler material has a good burn rate and smoke delivery as well as a reduced propensity to extinguish. Another advantage discovered with the present invention is the filler material has an increased tensile strength that better withstands shredding and other cigarette making processes than the filler material of the prior art. Also, an advantage of the present invention over the prior art is that the present invention reduces or eliminates spotting of the cigarette paper.

The Smokeable Tobacco Substitute Filler Having an Increased Fill Value and Method of Making Same claimed herein has a cellulose containing material in a range of 5% to 50%, a humectant in a range of up to 15%, a tobacco containing material in a range of up to 50% wherein a portion of the tobacco containing material may be a tobacco extract in a range of up to 30%, an inert material of up to 70%, and a binder in a range of 5% to 25%. The percentages of each of the constituents is based on a dry weight percentage of the final sheet. Additionally, the filler material of the present invention may have flavorants and casings added as desired.

The filler material claimed herein may be produced via a paper making process, bandcast process, or an extrusion process. The advantageous concentrations of the constituents making up the filler material vary based upon the process employed to practice this invention. The filler material of the present invention has a fill value of at least 4 cc/g and more closely exhibits the properties exhibited by natural tobacco.

We claim:

1. A process for making a smokeable filler comprising the steps of:

mixing a cellulose containing material selected from the group consisting of wood, cotton or flax to form a fibrous material product;

refining said fibrous material product;

mixing an inert material which has been precipitated and refined resulting in a very fine particle size in a range of about 0.5 μm to 1 μm, selected from the group consisting of chitosan, liposan, calcium carbonate, calcium oxide, magnesium oxide, and combinations thereof with said fibrous material product to form a fiber containing material;

making said fiber containing material into sheets via a paper making process; and cutting said sheets into strips forming said smokeable filler, wherein said smokeable filler has a fill value in excess of 5 cc/g.

2. The process for making a smokeable filler in claim 1 wherein said mixing a cellulose containing material step further comprises the mixing of a tobacco containing material wherein said tobacco containing material may make up to 50% by weight of said smokeable filler.

3. The process for making a smokeable filler in claim 1 wherein said sheets are sprayed with a tobacco extract prior to said cutting of said sheets.

4. The process for making a smokeable filler in claim 1 wherein said tobacco extract further has a humectant.

5. The process for making a smokeable filler in claim 4 wherein said humectant is in an amount that makes up to 15% by weight of said smokeable filler.

6. A process for making a smokeable filler comprising the steps of:

mixing a refined cellulose containing material selected from the group consisting of wood, cotton or flax, a tobacco containing material in an amount comprising up to 50% by weight of said smokeable filler, and an inert material, which has been precipitated and refined resulting in a very fine particle size in a range of about 0.5 μm to 1 μm, to form a fibrous material product;

mixing a binder solution with said fibrous material product to form a fiber containing material;

adding a humectant to said fiber containing material;

making said fiber containing material into sheets; and cutting said sheets into strips forming said smokeable filler, wherein said smokeable filler has a fill value in excess of 5 cc/g.

7. The process of claim 6 wherein said sheet is formed by a bandcast process.

8. The process of claim 6 wherein said sheet is formed by an extrusion process.

* * * * *